United States Patent [19]

Goto et al.

[11] 4,283,656

[45] Aug. 11, 1981

[54] TRAVELING WAVE TUBE DEVICES

[75] Inventors: Genichi Goto; Sadamasa Hanihara, both of Tokyo, Japan

[73] Assignee: Nippon Electric Co., Ltd., Tokyo, Japan

[21] Appl. No.: 96,543

[22] Filed: Nov. 21, 1979

[30] Foreign Application Priority Data

Nov. 29, 1978 [JP] Japan ..... 53/164371[U]

[51] Int. Cl.[3] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,847,608 | 8/1958 | Thornburg | 315/3.5 |
| 2,857,547 | 10/1958 | Klein et al. | 315/3.5 |
| 2,911,599 | 11/1959 | Klein et al. | 315/3.5 |
| 2,964,670 | 12/1960 | Bliss | 315/3.5 X |
| 3,227,913 | 1/1966 | Disman et al. | 315/3.5 |
| 3,398,315 | 8/1968 | Washburn | 315/3.5 |
| 3,617,802 | 11/1971 | Manoly | 315/3.5 |

*Primary Examiner*—Saxfield Chatmon, Jr.
*Attorney, Agent, or Firm*—Thompson, Birch

[57] ABSTRACT

In a traveling wave tube device of the type comprising a helix which causes a microwave power to interact with an electron beam and a periodic permanent magnet assembly for focusing the electron beam, there are provided a plurality of annular permanent magnets and a plurality of pole pieces which are alternately disposed between input and output member of the microwave. The permanent magnets and pole pieces define annular recesses and a plurality of troidal metal spring rings are disposed in each recess in thermal contact with the permanent magnets and a carbonaceous coating coated on a pumped enclosure containing the helix.

4 Claims, 2 Drawing Figures

TRAVELING WAVE TUBE DEVICES

BACKGROUND OF THE INVENTION

This invention relates to a traveling wave tube device, more particularly to an improvement of a periodic permanent magnet assembly of a traveling wave tube device.

As is well known in the art, the traveling wave tube device of the type referred to above comprises a pumped envelope made of such insulating material as glass or ceramic and containing therein an electron gun for emitting an electron beam, a helical delay line or helix for causing the electron beam to interact with a microwave power amplified, and a collector for collecting the electron beam passed through the helix; and a periodic permanent magnet assembly coaxially surrounding a portion of the envelope which contains the helix and support rods thereof.

The periodic permanent magnet assembly comprises means for input and output microwave power to and from the traveling wave tube, a plurality of cylindrical permanent magnets which are magnetized in the axial direction and disposed between the input/output means, and alternately disposed pole pieces having an inner diameter smaller than that of the permanent magnets, thereby producing periodic magnetic field for focusing the electron beam along the tube axis. Accordingly, the electron beam emitted by the electron gun travels through a path inside of the helix while being focused by the periodic permanent magnet assembly.

Meanwhile, the microwave power supplied to the input end of the helix via the input device is amplified by an energy coupling with the electron beam traveling through the inner space and then taken out as an amplified microwave power through the output end of the helix.

The microwave power output characteristics of this type of the traveling wave tube device are generally limited by the following two reasons.

One reason lies in the heat generated mainly on the output side of the helix due to the amplification of the microwave power. This heat generates unwanted gas in the tube or renders unstable the microwave output power due to temperature variation.

The amount of heat thus generated increases with the microwave power level thereby increasing the amount of the gas generated and instability of the microwave output power. Further, these phenomena limits the permissible microwave power of the helical delay line thus making it impossible to produce a large microwave power output.

In addition, when the microwave output power becomes unstable in a manner as above described, various limits would be imposed upon microwave communication systems utilizing the traveling wave device.

One solution of these problems is disclosed in Japanese utility model publication No. 21478/1978 dated June 5, 1978.

According to this utility model publication there is provided an expandable and contractable ring shaped electroconductive member which is fitted to the inner surfaces of the pole pieces of the periodic permanent magnet assembly, the outer surface of the electroconductive member being in contact with the permanent magnets and the inner surface being secured to the outer surface of the helix portion envelope. With this construction, the heat generated by the helix is conducted to the helix portion envelope through dielectric members provided for the purpose of supporting the helix, then to the permanent magnets and their pole pieces through the electroconductive members and finally dissipated to surrounding air.

With this construction since the heat is dissipated by the path described above, the cooling effect is improved over the prior art construction thus increasing the permissible heat capacity caused microwave power of the helix.

As the material for preparing the expandable and contractable electroconductive member is used a silicone rubber mixed with a powder of silver, or a troidal coil shaped ring is used.

The silicone rubber incorporated with a powder of silver is difficult to manifest uniform electroconductivity which is essential to the traveling wave tube device thus causing nonuniform heat radiation. A fatal defect of this construction lies in that the silicone rubber becomes hard and brittle due to aging thus losing the resiliency as well the heat conductivity.

Since the troidal coil shaped ring is wound one turn about the helix portion envelope, the problems caused by the silicone rubber would not be resulted. But as the contact areas between the envelope and the ring and between the ring and the pole pieces and the permanent magnets are small the heat conductivity is smaller than the construction utilizing the silicone rubber thus greatly reducing the cooling effect. Where a single troidal coil shaped ring is used undesirable phenomenon occurs wherein the microwave power is fed back to the input side from the output side of the microwave power amplifier device.

Moreover, the permissible heat capacity to the helix can not be increased in any appreciable extent because the cooling effect is not improved as exposed.

SUMMARY OF THE INVENTION

Accordingly, it is a principal object of this invention to provide an improved traveling wave tube device capable of efficiently dissipating the heat generated by a helix thereby improving the cooling effect.

Another object of this invention is to provide an improved traveling wave tube device capable of increasing the permissible heat capacity to a helix.

Still another object of this invention is to provide a novel traveling wave tube device capable of preventing unwanted microwave power from feeding back to the input side from the output side.

To accomplish these objects, according to this invention, a plurality of troidal coil shaped spring rings are disposed between recesses defined by the inner walls of permanent magnets and the pole pieces thereof whereby the heat conductivity between the permanent magnets, pole pieces and the helix portion envelope is improved. Further a carbonaceous film and a electroconductive film for preventing peeling off of the carbonaceous film are coated on the outer surface of the helix portion envelope for dissipating the radiant heat generated in the helix by the microwave power loss through the spring rings. As a consequence, the overall heat dissipation is improved greatly thus enhancing the cooling effect. This improved cooling effect permits larger microwave power output amplified on the helix.

According to this invention, there is provided a traveling wave tube device comprising a pumped envelope including an electron beam gun, an electron beam collector, a helix disposed between the electron beam gun and the electron beam collector, a helix portion envelope surrounding the elements described above, means disposed between the helix portion envelope and the helix for supporting the same, a carbonaceous coating applied on the helix portion envelope, and an electroconductive coating applied on the carbonaceous coating for preventing peeling off thereof, and a permanent magnet assembly which includes, means for input and output microwave power to and from the traveling wave tube, a plurality of annular permanent magnets and a plurality of pole pieces, the permanent magnets and pole pieces being alternately disposed between the input and output microwave power means, each of said pole pieces having a smaller inner diameter than that of the permanent magnets and larger than said helix portion envelope, and adjacent pole pieces and one of the permanent magnets interposed therebetween defining an annular recess, and a plurality of troidal metal rings contained in each annular recess and in contact with the electroconductive coating and the permanent magnets.

DESCRIPTION OF THE PREFERRED EMBODIMENTS

Figure 1:
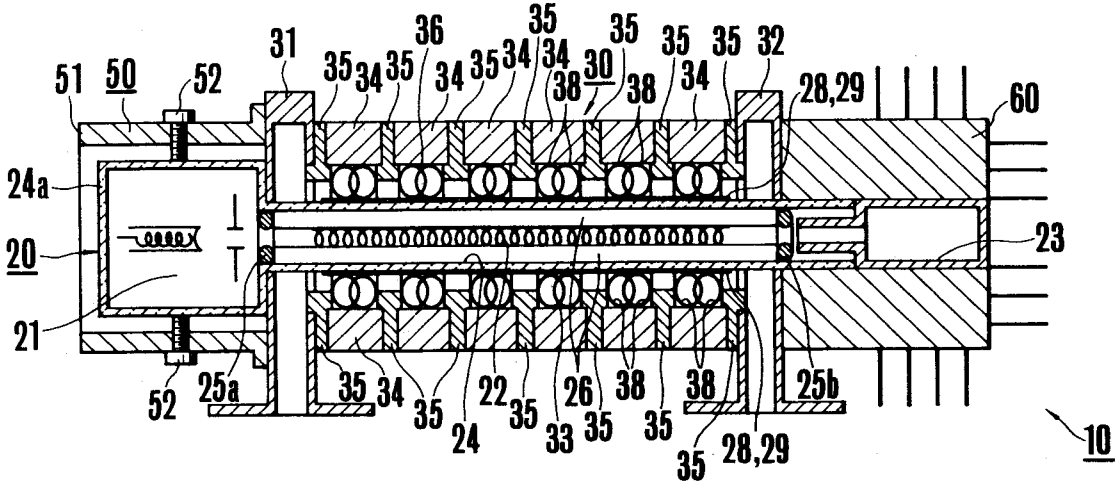
FIG. 1 is a longitudinal sectional view showing one embodiment of a traveling wave tube device according to this invention.

FIG. 1 shows a traveling wave tube device of this device constructed as a waveguide coupling type.

The traveling wave tube device 10 shown in FIG. 1 comprises a traveling wave tube 20, a periodic permanent magnet assembly 30 including input and output waveguide 31 and 32 which are disposed about the traveling wave tube 20 with a definite spacing, a waveguide position adjusting mechanism 50 comprising a supporting member 51 secured to the lefthand side of the input waveguide 31 and adjusting screws 52, and a heat dissipating member 60 connected to the righthand side of the output waveguide 32.

The traveling wave tube 20 comprises an electron gun 21 for emitting an electron beam, a helical delay line or helix 22 for causing the electron beam to interact with microwave power, a collector 23 for collecting the electron beam passing through the helix 22, and a helix portion envelope 24 including the helix 22. The helix portion envelope 24 forms an elongated circular exhausted envelope together with the collector 23. The opposite ends of the helix 22 are supported by a choke part 25*a* disposed close to the inner wall of the helix portion envelope 24 which faces the electron gun 21 and another choke part 25*b* disposed close to the opening of the collector 23. These choke parts also function to prevent the microwave from leaking towards electron gun 21 and the collector 23. The helix 22 is supported between the choke parts 25*a* and 25*b* by a plurality of supporting rods 26 (in this example, 120° spaced 3 rods) extending along the helix and equally spaced in the circumferential direction. These supporting rods 26 are made of such dielectric material as seramic or glass.

Figure 2:
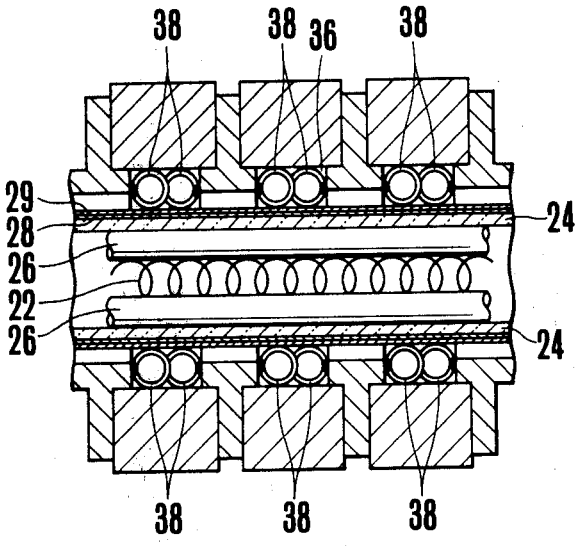
FIG. 2 is an enlarged sectional view showing the periodic permanent magnet assembly utilized in the traveling wave tube device shown in FIG. 1.

As shown in detail in FIG. 2, a carbon coating 28 is applied about the entire surface of the helix portion envelope 24 between the input and output waveguides 31 and 32 but no contact therewith. For the purpose of preventing peeling off of the carbon coating 28, a coating 29 made of an electroconductive epoxy resin, for example, is coated on the carbon coating 28. The carbon coating comprises one of the characteristic features of this invention and functions to absorb the heat radiated from the helix and to prevent the microwave leaking from the output waveguide 32 along the outer wall of the helix portion envelope from feeding back to the input waveguide 31.

The periodic permanent magnet assembly 30 is arranged about the helix portion envelope 24 containing the helix 22. This construction also constitutes another characteristic feature of this invention, and is shown in detail in FIG. 2. More particularly, the periodic permanent magnet assembly 30 takes the form of a cylinder and is disposed concentrically with the helix portion envelope 24. In addition to the input and output waveguide 31 and 32 described above, the assembly 30 further comprises a plurality of cylindrical permanent magnets 34 which are magnetized in the axial direction and a plurality of cylindrical pole pieces 35 each having an inner diameter smaller than that of the permanent magnets 34. The permanent magnets and the pole pieces are arranged alternately along the outer wall of the helix portion envelope 24 and between the input and output waveguide 31 and 32 so as to produce periodic magnetic field necessary to focus the electron beam emitted from the electron gun 21 along the tube axis.

Each pole piece 35 is provided with axial tabs at its inner end so that the tab of a pole piece to the right of the waveguide 31 is received in a notch thereof and the tab of a pole piece 35 to the left of the waveguide 32 is received in a notch thereof. Tabs of another pole pieces face each other and extend along the inner walls of permanent magnets 34 thereby forming annular recesses 36. According to this invention two troidal coil springs 38 made of metal, phosphor bronze, for example, are contained in each annular recess 36 between the inner surface of each permanent magnet and the coating 29 surrounding the helix portion envelope 24. Where the coated 29 has an outer diameter of 6 mm and the magnet 34 has an inner diameter of 10 mm, the ring 38 is constructed to have an outer diameter of 11.4 mm, an inner diameter of 6.4 mm and hence ring contour having a diameter of 5 mm. Consequently, turns of adjacent spring coils interleave each other, whereas the peripheries of each turn are strongly urged against the inner surface of the magnet and the end surfaces of adjacent tabs.

The construction described above results in the following advantages. Thus, the heat generated by the helical helix 22 is transmitted to the supporting rods 26 and then transmitted to the carbon coating 28 and electroconductive coating 29 via the helix portion envelope 24. At this time radiant heat absorbed by the carbon coating 28 is also transmitted to the electroconductive coating 29 in addition to the heat transmitted thereto through supporting rods 26. The heat is then transmitted to the magnets 34 and their pole pieces 35 through the spring rings 38 and finally dissipated into the surrounding air. As the contact areas between the spring rings 38 and the electroconductive coating 29 and between the spring rings 38 and the pole pieces 35 and permanent magnets 34 are increased by the construction just described the rate of heat conduction between these members can be increased remarkably. This construction can efficiently dissipate the heat caused by the microwave power loss in the helix.

As a consequence, the temperature in the helix portion envelope during operation as well as the quantity of gas generated can be reduced thereby preventing unstability of the microwave power output. In a traveling wave tube device of this invention operating at 11 GHz and has a saturation output of 14 W, it was confirmed by experiment that the variation of the output was reduced to only 0.01% which should be compared with 20% of the prior art construction. Decrease in the temperature in the helix portion envelope during operation means that it is possible to increase the permissible microwave output power of the helix. The carbon coating 28 interposed between the spring rings 38 and the helix portion envelope 24 prevents microwave power leaked from the output side from feeding back to the input side along the outer surface of the helix portion envelope 24.

It should be understood that the invention is not limited to the specific embodiment described above and that many changes and modification will be obvious to one skilled in the art. For example, although the embodiment was described with regard to a waveguide coupling type traveling wave tube device as an input/output device, the invention is also applicable to coaxial coupling type. The number of spring rings received in recesses defined by the inner walls of permanent magnets, the pole pieces and the helix portion envelope may be larger than two. The larger is the number, the larger is the contact area thus improving heat conduction.

What is claimed is:

1. A traveling wave tube device comprising a traveling wave tube including a source of an electron beam, an electron beam collector, a helical delay line disposed between said source of electron beam and said electron beam collector, a pumped envelope surrounding the elements described above, means disposed between said pumped envelope and said helical delay line for supporting the same, a carbonaceous coating applied on said pumped envelope and an electroconductive coating applied on said carbonaceous coating for preventing peeling off thereof; and a periodic permanent magnet assembly which includes means for a microwave power input and output to and from said traveling wave tube, a plurality of annular permanent magnets and a plurality of pole pieces, said permanent magnets and pole pieces being alternately disposed between the microwave power input and output means, each of said pole pieces having an inner diameter that is smaller than that of the permanent magnets and larger than that of said pumped envelope, adjacent pole pieces and one of the permanent magnets interposed therebetween defining an annular recess, and a plurality troidal metal spring rings contained in each annular recess and in contact with said electroconductive coating and said permanent magnets.

2. The traveling wave tube device according to claim 1 wherein each pole piece is provided with tabs on both sides of the inner surface thereof said tabs partially covering the inner surface of the permanent magnet.

3. The traveling wave tube according to claim 1 wherein said carbonaceous coating and said electroconductive coating are provided to cover substantially all peripheral surface of said pumped envelope between said microwave power input and output means.

4. The travelling wave tube according to claim 1 wherein said electroconductive coating comprises an electroconductive epoxy resin coating.

* * * * *